US005613282A

United States Patent [19]

Deddens, Sr. et al.

[11] Patent Number: 5,613,282

[45] Date of Patent: Mar. 25, 1997

[54] SEALING APPARATUS

[76] Inventors: John A. Deddens, Sr., 5230 Ridgewood Rd., Jackson, Miss. 39211; Charles W. Thomas, 1895 Steeplebrook Cove, Cordova, Tenn. 38018

[21] Appl. No.: 532,394

[22] Filed: Sep. 22, 1995

[51] Int. Cl.[6] ..... B65D 77/10

[52] U.S. Cl. ..... 24/30.5 R; 24/460; 248/206.5

[58] Field of Search ..... 248/206.5; 24/30.5 R, 24/399, 400, 461, 462, 460, 587, 716, 303; D9/434

[56] References Cited

U.S. PATENT DOCUMENTS

| | | | |
|---|---|---|---|
| D. 264,689 | 6/1982 | Miller | D9/434 |
| D. 276,596 | 12/1984 | Kisha | D9/434 X |
| D. 301,548 | 6/1989 | Weaver | D9/434 |
| 644,358 | 2/1900 | Kammer | 24/460 X |
| 2,586,931 | 2/1952 | Gammon | D9/434 X |
| 3,141,221 | 7/1964 | Faulls, Jr. | 24/30.5 R |
| 3,266,711 | 8/1966 | Song | 24/30.5 R |
| 3,458,110 | 7/1969 | Goldman | D9/434 X |
| 3,629,905 | 12/1971 | Cote | 24/30.5 R |
| 4,953,714 | 9/1990 | Paul | 248/206.5 X |
| 4,960,521 | 10/1990 | Keller | 24/30.5 R X |
| 4,985,817 | 1/1991 | Yale | 248/206.5 X |
| 4,991,267 | 2/1991 | Apperson et al. | 24/30.5 R |
| 5,079,806 | 1/1992 | Allen | 24/30.5 R |
| 5,249,336 | 10/1993 | Miller | 24/303 X |
| 5,267,374 | 12/1993 | Drake | 24/303 X |
| 5,371,925 | 12/1994 | Sawatcky | 24/30.5 R |
| 5,379,489 | 1/1995 | Delk et al. | 24/30.5 R |

FOREIGN PATENT DOCUMENTS

| | | | |
|---|---|---|---|
| 811444 | 8/1951 | Germany | 24/30.5 R |

*Primary Examiner*—Peter M. Cuomo
*Assistant Examiner*—Robert J. Sandy
*Attorney, Agent, or Firm*—Nixon & Vanderhye, P.C.

[57] ABSTRACT

A sealing apparatus (20) for engaging or sealing flexible material (22) comprises an elongated locking or roller member (30) and a channel-forming member or frame (40). The frame (40) has opposing cantilevered panels (42, 44) between which a channel (50) is formed, the cantilevered panels (42, 44) being resilient panels which accommodate insertion of the roller (30) into the channel (50) and withdrawal of at least a portion of the roller from the channel, whereby the flexible material (22) is engaged between the roller (30) and the frame (40) when the roller is inserted into the frame. The roller (30) is pivotally connected to the frame (40), and has a handle end (32) which protrudes past the frame (40) to facilitate withdrawal therefrom. An external surface of frame (40) has a recess which accommodates a magnet (80) fitted therein to facilitate attachment of the sealing apparatus to metallic surfaces.

15 Claims, 3 Drawing Sheets

SEALING APPARATUS

BACKGROUND

1. Field of Invention

This invention pertains to sealing apparatus of a type utilized to grasp or seal closed a flexible material, such as a flexible bag, for example.

2. Related Art and Other Considerations

Flexible materials containing product, such as potato chip bags or the like, should be closed after initial opening to preserve freshness or purity of the product. Heretofore various mechanisms have been employed to re-close such flexible materials. Prior art re-closing mechanisms include several types of a wire-reinforced ties which wind around a gathered end of the material, e.g., around an opened end of a bag. Other re-closing mechanisms include a hinged clip or the like having opposing jaw members which engage a folded end of the material.

Few prior art re-closing mechanisms for flexible bags are air-tight, and thus compromise the product stored in the bags. Moreover, use of prior art re-closing mechanisms is often unsightly, as the flexible material must be unnaturally wound or gathered to accommodate re-closing.

Accordingly, it is an object of the present invention to provide a sealing apparatus which tightly grasps flexible material.

SUMMARY

A sealing apparatus for engaging or sealing flexible material comprises an elongated locking or roller member and a channel-forming member or frame. The frame has opposing cantilevered panels between which a channel is formed, the cantilevered panels being resilient panels which accommodate insertion of the roller into the channel and withdrawal of at least a portion of the roller from the channel, whereby the flexible material is engaged between the roller and the frame when the roller is inserted into the frame. The roller is pivotally connected to the frame, and has a handle end which protrudes past the frame to facilitate withdrawal therefrom. An external surface of frame has a recess which accommodates a magnet fitted therein to facilitate attachment of the sealing apparatus to metallic surfaces.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
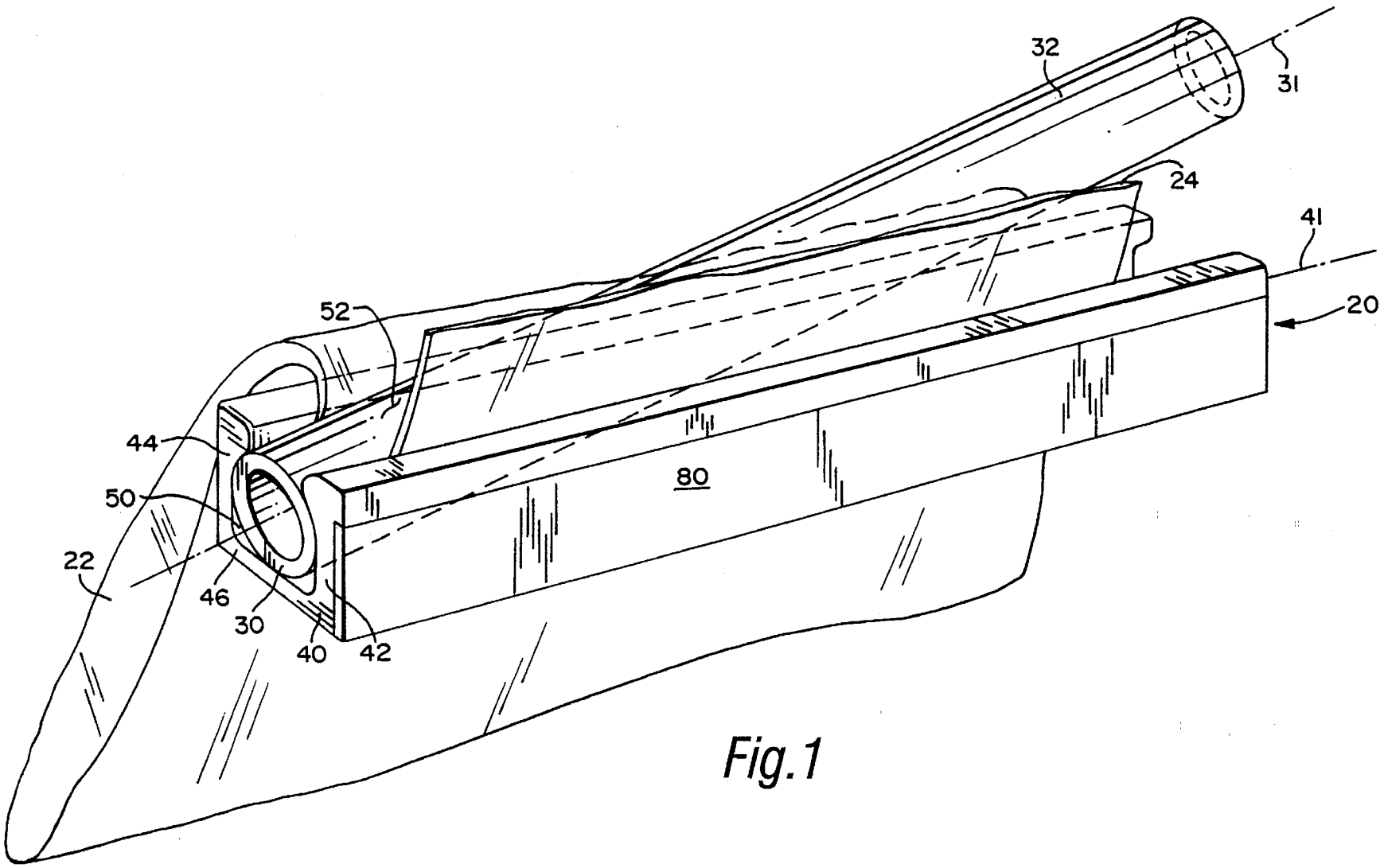
FIG. 1 is a back perspective view of sealing apparatus according to an embodiment of the invention, showing an insertion of flexible material therein.

FIG. 1 shows sealing apparatus 20 according to an embodiment of the invention, with sealing apparatus 20 engaging a flexible bag 22 having a previously-opened mouth end 24. Sealing apparatus 20 comprises an elongated locking member or roller 30 and a channel-forming member or frame 40. Roller 30 has an axis of elongation 31 (see FIG. 2A); frame 40 has an axis of elongation 41 and has a substantially parallelepiped shape. In the illustrated embodiment, both roller 30 and frame 40 are formed from plastic.

In the illustrated embodiment, the locking member 30 (also known as the roller) has an essentially hollow, tubular or cylindrical shape. It should be understood that locking member 30 can acquire other shapes in other embodiments. Roller 30 has a handle end 32 and an attachment end 34 (see FIG. 2C).

Figure 3:
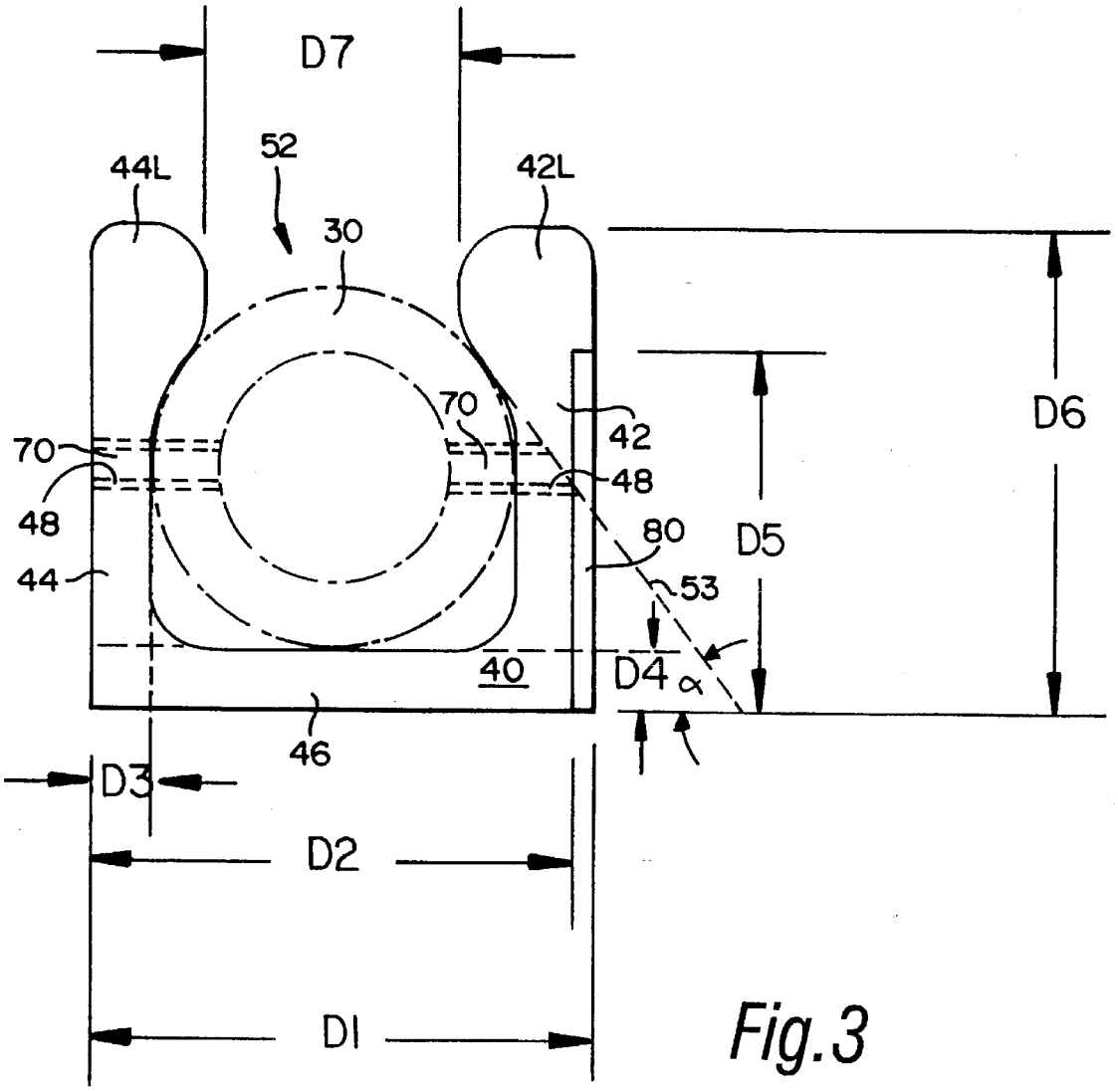
FIG 3 is a side view of the sealing apparatus of FIG. 2A.

Channel-forming member or frame 40 has an elongated, substantially rectangular shape defined by back panel 42, front panel 44, and bottom panel 46. Back panel 42 and front panel 44 are opposing cantilevered panels between which a channel 50 is formed. Thus, as seen in FIG. 3, frame 40 has an essentially U-shaped external cross section in a plane perpendicular to its axis 41 of elongation.

Cantilevered panels 42, 44 are resilient panels which accommodate insertion of the locking member 30 into channel 50 and withdrawal of at least a portion of the locking member 30 from channel 50. Distal ends of panels 42, 44 terminate with interiorly rounded lips 42L, 44L, respectively (see FIG.3). Opposite bottom panel 46 and between lips 42L, 44L is an elongated channel mouth 52. For one embodiment, dimensions D1–D7 of frame 40 are listed (in inches) in Table 1. In the illustrated embodiment, interior corners of channel 50 are radiused at 0.0625 inches. When roller 30 is fully inserted in frame 40, a tangent 53 to a roller-contacting segment of lips 42L, 44L is inclined at an angle $\alpha$ with respect to bottom panel 46 (see FIG. 3), angle $\alpha$ being 32 degrees in the illustrated embodiment.

TABLE 1

| D1 | D2 | D3 | D4 | D5 | D6 | D7 |
|---|---|---|---|---|---|---|
| 0.52 | 0.50 | 0.06 | 0.06 | 0.375 | 0.50 | 0.26 |

Figure 2A:
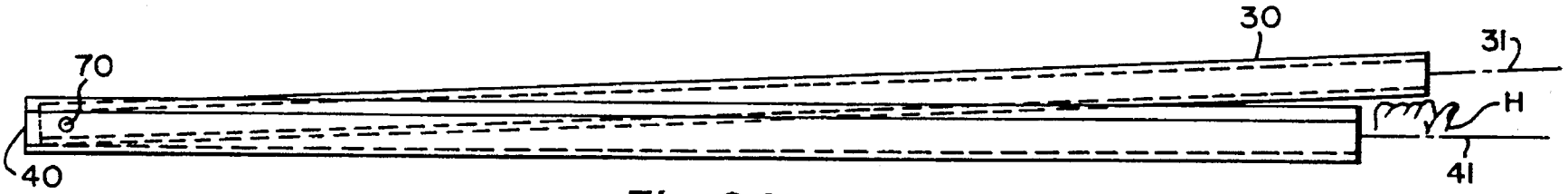
FIG. 2A is a back view of the sealing apparatus of FIG. 1.

Roller attachment end 34 of roller 30 is pivotally attached proximate a first elongated end inside the frame 40 (see FIG. 2A). As understood from FIG. 3, aligned apertures 48 are formed in frame panels 42 and 44 with aligned apertures 38 formed in roller 30, facilitating insertion of pivot pins 70. Rather than two pivot pins 70 being provided as shown in FIG. 3, a single pivot pin spanning panels 42 and 44 and extending through the diameter of roller 30 can be provided.

In use, a user lays a top portion of flexible material 24 over channel mouth 52, with flexible material 24 being offset along axis 41 so as to clear pivot pin 70. Then, the user (preferably holding handle 32) pivots roller 30 about pivot pin(s) 70 in a downward direction (e.g., toward bottom panel 46) and exerts sufficient force that roller 30 urges lips 42L, 44L to separate, thereby gaining admission of roller 30, and flexible material 24 thereunder, into channel 50. Once roller 30 is entirely in channel 50, the resilient nature of panels 42, 44 causes lips 42L, 44L to close and retain roller 30 in channel 50, as shown in FIG. 3. Thus, the flexible material 22 is engaged between roller 30 and the interior of frame 40 when roller 30 is inserted into channel 50. If the flexible material 22 is a previously-opened bag or the like, engagement between roller 30 and the interior of frame 40 provides an air-tight sealing for flexible material 22.

Figure 2B:
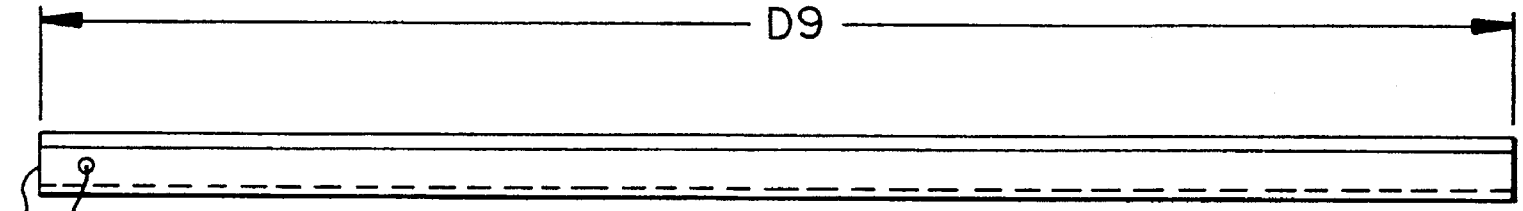
FIG. 2B is a back view of a channel-forming member or frame of the sealing apparatus of FIG. 1.
Figure 2C:
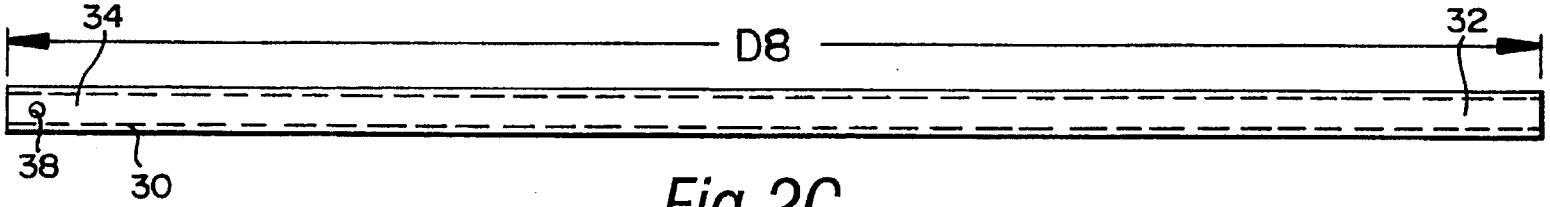
FIG. 2C is a back view of a locking member or roller of the sealing apparatus of FIG. 1.

As understood from FIG. 2A and FIG. 1, when roller 30 is inserted into frame 40, handle end 32 of roller 30 protrudes past frame 40 to facilitate eventual withdrawal of at least a portion of roller 30 from frame 40. In this regard, a hand (illustrated as H in FIG. 2A) applying an upward force on roller 30 snaps roller 30 from engagement between resilient panels 42, 44 of frame 40, thereby freeing material 22 from apparatus 20. As shown in FIG. 2B and FIG. 2C, the length D9 of roller 30 exceeds the length D8 of frame 40, with D9 and D8 being 12.5 inches and 12.0 inches, respectively, in the illustrated embodiment.

As illustrated in FIG. 1 and FIG. 3, for example, an external surface of the back panel 42 is optionally provided with a recess formed therein for accommodating a magnet 80. Magnet 80 permits sealing apparatus to be attached to metallic devices, such as a refrigerator, for example.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

What is claimed is:

1. Apparatus for sealing flexible material comprising:

a substantially parallelepiped frame having a back panel, a front panel, a bottom panel and an inner channel, the inner channel communicating with an at least partially opened channel mouth formed between resilient lips provided on a top side of the frame, the inner channel accommodating the flexible material through the channel mouth; and a cylindrical roller attached to the frame for pivotal movement of the roller into the channel toward a sealing position whereat the roller engages the sealable mouth of the flexible material between the roller and the frame, the resilient lips permitting pivoting of the roller into the channel between the lips for engagement of the flexible material by the roller.

2. The apparatus of claim 1, wherein the roller is attached to the frame by a pin.

3. The apparatus of claim 1, further comprising a magnet attached to the back panel.

4. The apparatus of claim 2, wherein the magnet is accommodated in a recess formed on the back panel.

5. The apparatus of claim 1, wherein the roller is attached to the frame at a pivot point, the pivot point being located inside the frame.

6. The apparatus of claim 1, wherein the channel has a bottom wall housed between two parallel side walls, lower portions of the two parallel side walls being substantially straight, said channel having upper portions of the two parallel side walls, the upper portions being inclined at an angle to the bottom panel of the frame to form the resilient lips.

7. The apparatus of claim 6, wherein the angle is substantially 32 degrees.

8. The apparatus claim 1, wherein the channel has an interior corner of substantially 0.0625 inches.

9. The apparatus claim 1, wherein the width of the channel mouth is substantially 0.26 inches.

10. The apparatus claim 1, wherein the frame has a width of 0.52 inches.

11. The apparatus claim 1, wherein the frame has a height of 0.50 inches.

12. The apparatus claim 1, wherein the frame has a length of 12.0 inches.

13. The apparatus claim 1, wherein the roller has a length of 12.5 inches.

14. The apparatus claim 1, wherein the frame is made of resilient material.

15. The apparatus of claim 1 wherein the roller has a greater diameter than a width of the channel mouth.

* * * * *